US005735211A

United States Patent [19]

Parks et al.

[11] Patent Number: 5,735,211

[45] Date of Patent: Apr. 7, 1998

[54] CLAMPING AND TENSIONING DEVICE FOR PRINTING PLATES

[75] Inventors: Thomas Dewayne Parks, Tacoma; Michael Rolland Turner, Renton, both of Wash.; Dale Leon Bunnell, Chesterfield; Gary Wilson Teeter, St Louis, both of Mo.

[73] Assignee: Mark Andy, Inc., Chesterfield, Mo.

[21] Appl. No.: 661,789

[22] Filed: Jun. 13, 1996

[51] Int. Cl.[6] ..... B41F 21/00

[52] U.S. Cl. ..... 101/415.1; 101/DIG. 36

[58] Field of Search ..... 101/415.1, 382.1, 101/383, DIG. 36

[56] References Cited

U.S. PATENT DOCUMENTS

| | | | |
|---|---|---|---|
| 5,062,363 | 11/1991 | Reichel | 101/415.1 |
| 5,271,324 | 12/1993 | Kiamco et al. | 101/415.1 |
| 5,329,853 | 7/1994 | Stegmeir et al. | 101/415.1 |
| 5,485,784 | 1/1996 | Walschlaeger, Sr. | 101/415.1 |

FOREIGN PATENT DOCUMENTS

| | | | |
|---|---|---|---|
| 0 331 777 A | 9/1989 | European Pat. Off. . | |
| 2631119 | 1/1978 | Germany | 101/415.1 |
| 42 10 778 A | 10/1993 | Germany . | |
| 411 941 A | 11/1966 | Switzerland . | |
| 0181664 | 10/1966 | U.S.S.R. | 101/415.1 |
| 0765024 | 9/1980 | U.S.S.R. | 101/415.1 |

*Primary Examiner*—Christopher A. Bennett
*Attorney, Agent, or Firm*—Foley & Lardner

[57] ABSTRACT

A printing cylinder system for use in a printing press comprising a unique apparatus and method for tensioning and releasing a flexible printing plate that is wrapped around a printing cylinder and clamped by a clamping mechanism disposed within the printing cylinder and accessed by a longitudinal slot. The invention features a mounting mechanism for holding the clamp mechanism in a relative position within the printing cylinder and including control means for moving the clamping mechanism within the printing cylinder substantially toward or away from the cylindrical slot to either apply tension to the printing plate or release tension on the printing plate. In a further embodiment, the invention comprises a piston assembly for pushing the edge or edges of the printing plate outwardly toward the cylindrical slot opening, upon actuation.

35 Claims, 6 Drawing Sheets

CLAMPING AND TENSIONING DEVICE FOR PRINTING PLATES

BACKGROUND OF THE INVENTION

The present invention relates generally to the printing process, and more specifically to a method and apparatus for clamping and tensioning a printing plate on a printing cylinder.

In order for a printing process to be economically feasible for the production of products for what is commonly referred to as "the web fed label market", the process must be able to maintain the material waste and the cost of the tooling to a minimum. The process must also be as simple to set up, operate and clean as possible to allow the process to be competitive with other printing processes commonly used in the web fed label market.

Offset printing has always been recognized as the printing process that will provide the highest quality of printing possible as compared to flexographic, letter press, rotary screen, or other printing processes. Gravure is the only other process that rivals offset printing in quality, but the high cost of gravure printing cylinders prevents gravure from being economically feasible for the web fed label industry, except in very long run, fixed repeat applications.

However, the offset printing process has not been used in the web fed label industry primarily because of the lack of variable repeat capability and the waste that would be generated by the typically wide "plate gap" seen in most offset print cylinders. Specifically, because the material is usually the most expensive item in any job and because the wide plate gap creates a large amount of unprinted material that is waste, this process is generally not economically feasible.

With reference to the problems encountered in the offset printing process, the offset printing industry uses a metal printing plate that is difficult to retain positively to the printing cylinder. The normal method of attachment of this metal printing plate is with a clamping device that is located internal to the cylinder and rigidly attached to the cylinder. The printing plate is normally fed to the clamping device through a slot in the external surface of the printing cylinder. The use of this type of slot configuration typically results in a large plate gap.

Because mounting of the flexible printing plate is effected typically by forming a longitudinal slot in the printing cylinder and inserting the flexible printing plate edge into this slot to make registry with a clamping device internal to the printing cylinder, it is generally not easy to clamp, tension, or release the printing plate. This results in significant printing plate change-over time and press down-time. In the label market which requires variable repeat plate cylinders with high quantities of tooling rolls, this excessive change-over time and press down-time is unacceptable. For example, a typical repeat range for a web fed label press is from 12 inches to 24 inches at ⅛ inch increments, resulting in 96 different diameter plate cylinders possible for each printing tower. Using offset presses for this label market process would result in the use of 96 blanket cylinders, with attendant change-over requirements.

OBJECTS OF THE INVENTION

Accordingly, it is an object of the present invention to reduce the printing plate change-over time for a printing cylinder.

It is a further object of the present invention to generally reduce the press down-time during printing plate change-over.

It is a still further object of the present invention to increase the ease with which tension may be applied to a flexible printing plate being wrapped on a printing cylinder.

It is a further object of the present invention to allow a narrow plate gap on the printing cylinder.

A yet further object of the present invention is to increase the ease of release of the printing plate from the printing cylinder when it is time for printing plate adjustment or removal.

A yet further object of the present invention is to create a clamp mechanism which is easily reusable in almost every size plate roll to avoid a proliferation of parts and costs.

SUMMARY OF THE INVENTION

Briefly, the above and other objects are realized in a printing cylinder system comprising a printing cylinder having a narrow first slot extending lengthwise in an outer surface in the printing cylinder; a clamp mechanism disposed movably within the volume of the printing cylinder for clamping a flexible printing plate securely around the printing cylinder; a mounting mechanism for holding the clamp mechanism in a relative position within the printing cylinder and including control means for moving the clamp mechanism within the printing cylinder substantially toward or away from the first slot; wherein the clamping mechanism comprises a plate clamp block with a longitudinal clamping slot disposed therein, with the clamping slot having its opening aligned to communicate with the outer surface of the plate clamp block, the clamping slot disposed to communicate with the first slot to receive and hold at least one edge of the flexible printing plate via the first slot; wherein once the at least one end of the flexible printing plate is received and held within the clamping slot, the mounting mechanism is controlled to move the clamp mechanism relative to the first slot to tighten the flexible printing plate around the printing cylinder.

In a further refinement of the invention, the control means in the mounting mechanism comprises at least one adjustable fastener for securing and adjustably tightening the clamping mechanism within the printing cylinder, with the relative position of the clamping mechanism within the printing cylinder being controllable by adjusting at least one fastener.

In a refinement of this embodiment, the printing cylinder may comprise a first and second shafts disposed co-axially at either end of the printing cylinder, and the clamping mechanism may include a first and second ends thereof which extend through openings in end caps in the printing cylinder so as to be positioned in parallel and spaced from the first and second shafts of the printing cylinder. Threaded fasteners may then be utilized to connect the first end of the clamping mechanism to the first shaft of the printing cylinder, and to connect the second end of the clamp mechanism to the second shaft of the printing cylinder, with these threaded fasteners providing adjustment of the location of the clamping mechanism in its relative position within the printing cylinder.

In a yet further embodiment of the present invention, the clamping slot in the plate clamp block may be designed to narrow as it reaches the outer surface of the plate clamp block, and the clamping mechanism may further comprise a clamping shaft disposed within the clamping slot and having a cross-sectional dimension larger than the opening in the clamping slot so that the clamping shaft is retained within the clamping slot. The plate clamp block may further include a first bias device for biasing the clamping shaft to urge it toward the opening in the clamping slot at the opening in the clamping slot so that when the at least one edge of the flexible printing plate is inserted through the first slot and into the clamping slot, the first bias device pushes the clamping shaft against the edge of the flexible printing plate.

In a yet further embodiment of the present invention, the printing cylinder system may include at least one piston disposed within the plate clamp block and aligned so that one end surface thereof is capable of pushing the at least one end of the flexible printing plate in the clamping slot outwardly toward the outer surface of the plate clamp block. This embodiment further includes a second bias device for biasing the piston to urge the one end thereof in a direction away from the at least one end of the flexible printing plate, and an actuating device for causing the piston to exert pressure to push the at least one end of the flexible printing plate toward the opening in the clamping slot at the outer surface of the plate clamp block, upon actuation. In one embodiment, this actuating device may comprise a cam disposed in the clamping slot to pivot so that a first surface of the cam contacts the piston and causes the piston to push the at least one end of the flexible printing plate toward the clamping slot opening at the outer surface of the plate clamp block, and a pivot actuation device for causing the cam to pivot upon actuation.

In a yet further embodiment of the present invention, the pivot actuation device may comprise the juxtaposition of the clamping shaft in relation to a second surface of the cam so that when the clamping shaft is pushed by an external force inward into the clamping slot, the clamping shaft comes in contact with the second surface of the cam and causes the cam to pivot and contact the piston.

In a yet further embodiment of the present invention, the printing cylinder system comprises a printing cylinder having a narrow first slot extending lengthwise in an outer surface of the printing cylinder; a clamp mechanism disposed within the volume of the printing cylinder, the clamp mechanism including a longitudinal clamping slot running in parallel with the printing cylinder and the first slot, with its opening aligned to communicate with the first slot for receiving at least one edge of a flexible printing plate via the first slot and clamping the flexible printing plate securely around the printing cylinder; and a device for pushing the at least one edge of the flexible printing plate outwardly toward the opening in the clamping slot at the outer surface of the plate clamp mechanism upon activation, when the printing plate is to be adjusted or changed. In a preferred embodiment of this configuration, the pushing device may comprise at least one piston disposed within the clamping mechanism, a first bias device for biasing the piston to urge one end thereof in a direction away from the at least one end of the flexible printing plate, and an actuation device for causing the piston to exert pressure to push the at least one end of the flexible printing plate toward the opening in the clamping slot upon activation.

In a further refinement of the foregoing embodiment, the printing cylinder system may further comprise a mounting mechanism for holding the clamp mechanism within the printing cylinder and means for moving the clamp mechanism within the printing cylinder either substantially toward or away from the first slot in order to either tighten or loosen the flexible printing plate around the printing cylinder.

In a yet further embodiment, the present invention comprises a method for securing and releasing a flexible plate that is wrapped around a cylinder, with at least one edge of the flexible plate being insertable into a narrow slot extending lengthwise in the outer surface of the cylinder, and wherein a clamping mechanism disposed movably within the cylinder clamps to the edge of the flexible plate inserted through the narrow slot, with the method comprising the steps of: inserting the edge of the flexible plate into the narrow slot in the cylinder; clamping the edge of the flexible plate with the clamping mechanism disposed within the cylinder; and moving the clamping mechanism substantially away from the narrow slot to tighten the flexible plate around the cylinder.

In a further embodiment of the present invention, the method may include the step of: when it is time to change the flexible plate, moving the clamping mechanism substantially toward the narrow slot to reduce the tension on the flexible plate.

In a yet further refinement of the present invention, this method may comprise the step of pushing the edge of the flexible plate outwardly from within the clamping mechanism toward the narrow slot.

DETAILED DESCRIPTION OF THE PREFERRED EMBODIMENTS

Figure 1:
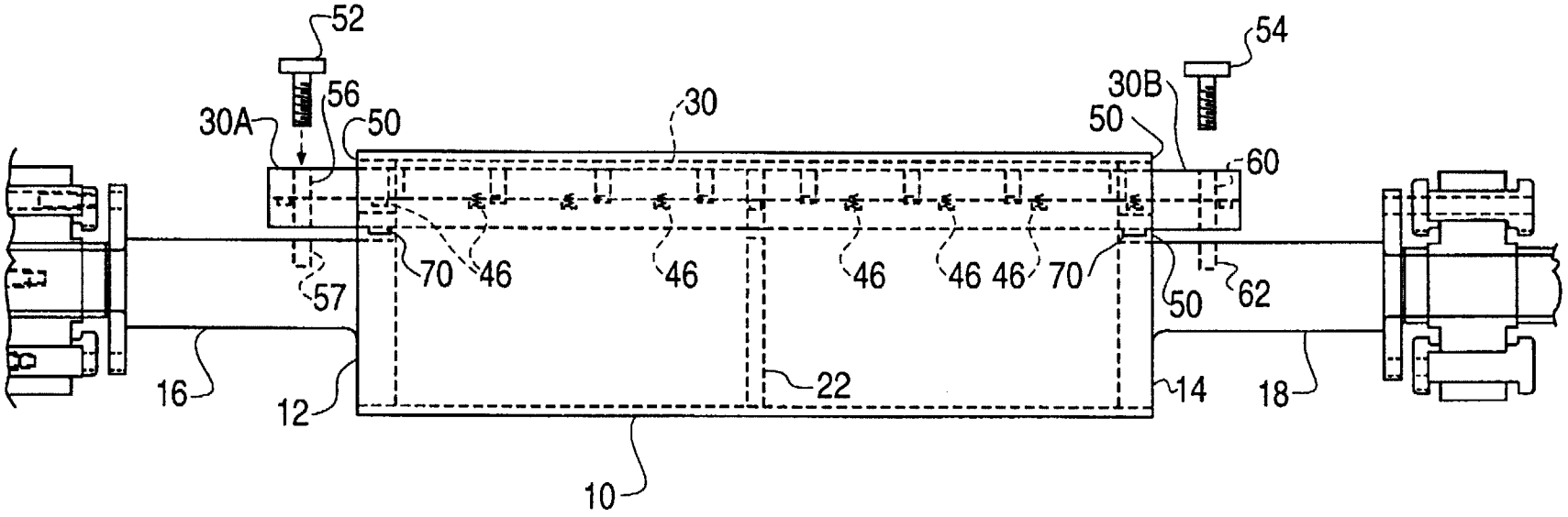
FIG. 1 is a side view of the printing cylinder system of the present invention.
Figure 2:
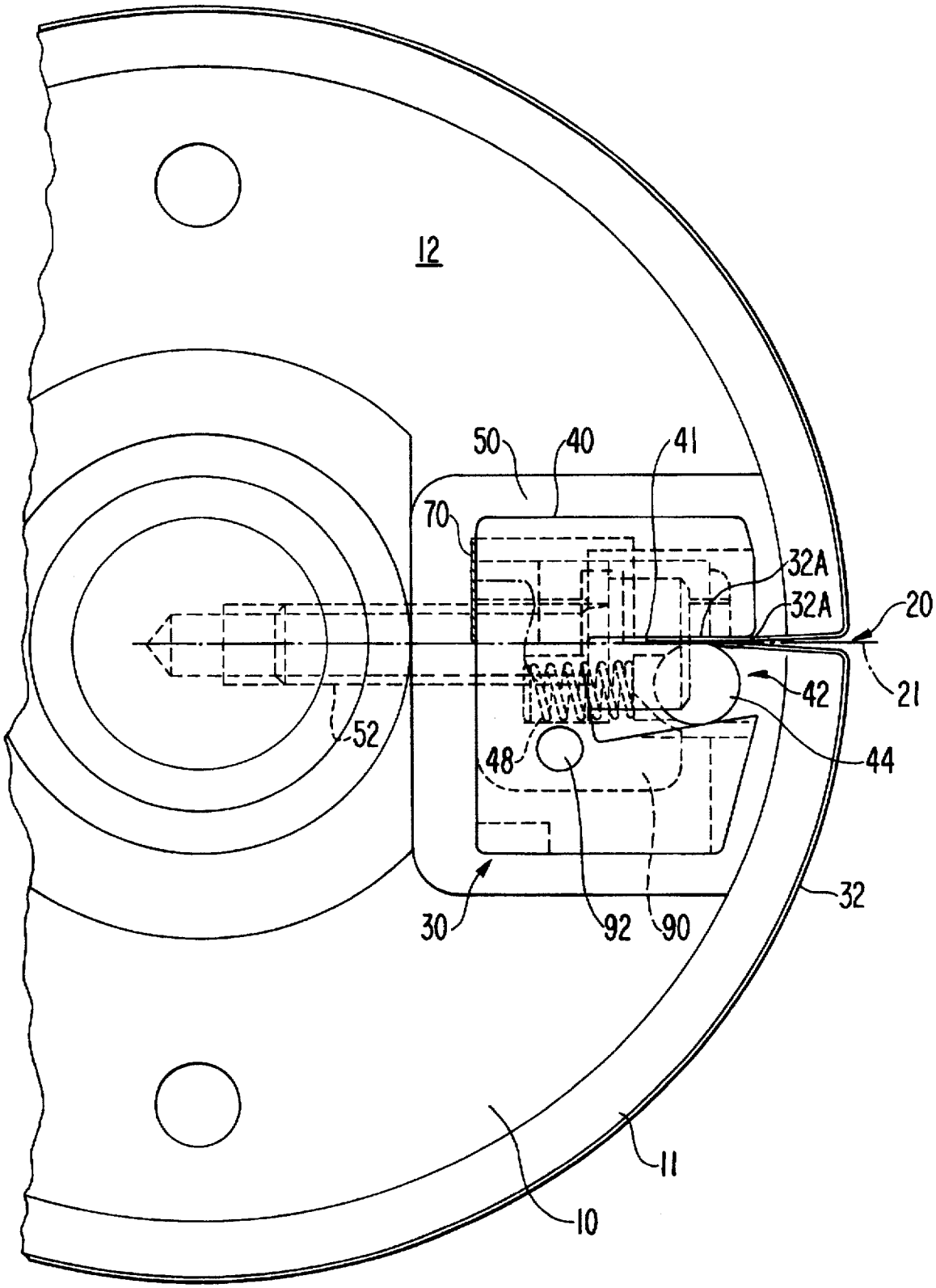
FIG. 2 is an end view of the present-invention.

Referring now to FIGS. 1–5, there are shown a variety of views of the printing cylinder system of the present invention. The side view of FIG. 1 and the end view of FIG. 2 show a printing cylinder 10 having a narrow first slot 20 extending lengthwise in an outer surface in the printing cylinder. In a preferred embodiment, this printing cylinder may be a hollow Weldment sleeve 11 with end caps 12 and 14 disposed at the respective ends of the sleeve. The configuration further includes a first shaft 16 and a second shaft 18, disposed one at either end of the printing cylinder 30 and concentric therewith. In a preferred embodiment, these two first and second shafts 16 and 18 may comprise bearing journals, with the attachment of the end caps 12 and 14 and the bearing journals 16 and 18 being accomplished through welding attachment. A support member 22 may be welded at one or more locations within the printing cylinder to prevent deflection or bowing for long printing cylinder rolls. These support members would be disposed across the diameter of the printing cylinder at various appropriate locations.

The present invention further comprises a clamping mechanism 30 disposed movably within the volume of the printing cylinder 10 for clamping a flexible printing plate 32 securely around the printing cylinder 10. The clamping mechanism is shown individually in FIG. 5.

The narrow slot 20 in the hollow sleeve of the printing cylinder 10 may be approximately 3 mm in width machined into the outer periphery of the printing cylinder 10 for the full length of the printing cylinder. Note that the printing cylinder 10 must be machined with the proper undercut diameter to match the desired repeat length after the printing plate 32 has been wrapped around the printing cylinder 10 and clamped.

The clamping mechanism 30 comprises a plate clamp block 40 with a longitudinally running clamping slot 42 disposed therein. The clamping slot 42 is disposed to communicate with the narrow first slot 20 in order to receive and hold at least one edge 32A of the flexible printing plate 32 via the first slot 20. The plate clamp block 40 further comprises a clamping shaft 44 disposed within the clamping slot 42 and having a cross-sectional dimension larger than the opening in the clamping slot 42 so that the clamping shaft 44 is retained within the clamping slot 42. It should be noted that the clamping shaft 44 may be cylindrical in shape. The clamping mechanism 30 further comprises a first bias device 46 for biasing the clamping shaft 44 to urge it toward the opening in the clamping slot 42. In the preferred embodiment, this first bias device may comprise a spring.

In operation, when at least one end of the flexible printing plate 32 is inserted through the first slot 20 and into the clamping slot 42, the first bias device 46 pushes the clamping shaft 44 against the edge 32A of the flexible printing plate 32. In a preferred embodiment, both edges 32A of the flexible printing plate 32 may be clamped by the clamping mechanism 30.

In a preferred embodiment of the present invention, the clamping mechanism 30 will extend the entire length of the printing cylinder 10. Accordingly, the plate clamp block 40 and the clamping shaft 44 will also extend the entire length of the printing cylinder 10. In such an embodiment, there may be a plurality of first biasing devices 46 disposed along the length of the clamping shaft 44. This plurality of first biasing devices 46 is shown in the side and the top views of the clamping mechanism 30 in FIG. 3A and FIG. 3B. The springs 46, that may be used to implement the first biasing device, may each be disposed on a spring bed 48.

In the preferred embodiment of the present embodiment, the clamping mechanism 30 has a first end 30A which extends through the end cap 12 in parallel and spaced from the bearing journal 16. Likewise, the clamping mechanism 30 has a second end 30B which extends through the end cap 14 of the printing cylinder 10 so that it extends in parallel and spaced from the bearing journal 18. In order to accommodate the extensions of these ends 30A and 30B through the respective end caps 12 and 14, slots 50 are machined into the end caps 12 and 4. These slots 50 are made large enough so that the clamping mechanism 30 may be moved within the slot openings 50 substantially toward or away from the first slot 20. Note that comparable openings would also be required in any supports 22 disposed within the printing cylinder 10. In this embodiment of the present invention, the mounting mechanism for mounting the clamping mechanism 30 relative to the printing cylinder 10, comprises a first adjustable fastener, which in the figure, is implemented by a first threaded fastener 52 and a second threaded fastener 54 for securing the first and second ends of the clamping mechanism 30 to the bearing journals 16 and 18, respectively. The threaded fastener 52 is received through the tapped hole 56 in the end 30A of the clamping mechanism 30 and the tapped hole 57 in the bearing journal 16. Likewise, the threaded fastener 54 is received by the tapped hole 60 in the second end 30B of the clamping mechanism 30 and the tapped hole 62 in the bearing journal 18. By rotating the threaded fasteners 52 and 54 clockwise, this will cause the clamping mechanism 30 to be drawn or moved toward the bearing journals 16 and 18 and substantially away from the narrow first slot 20. Note that for optimum operation, the threaded fasteners 52 and 54 should be aligned on the same center line 21 as the slot 20. It should be understood that the adjustable fasteners 52 and 54 could take a variety of other forms, such as adjustable clamps, for example. The important feature for whatever fastener is chosen, is that it is adjustable over a range of tightnesses.

Figure 3A:
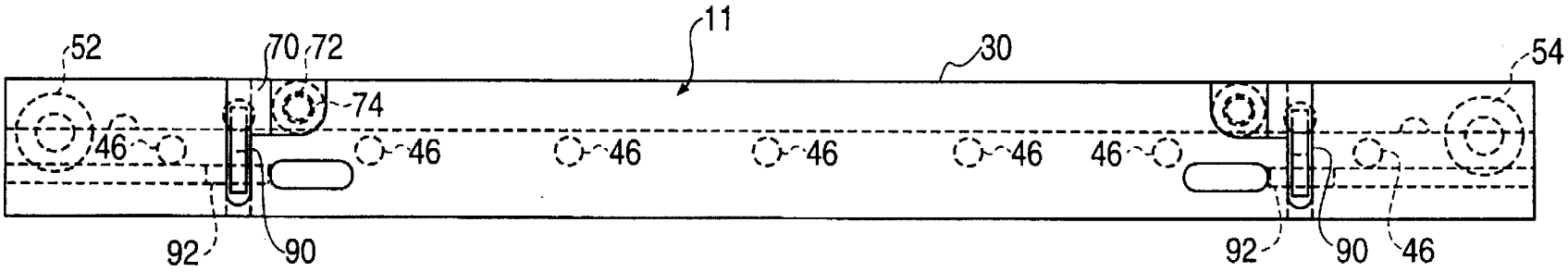
FIG. 3A is a top view of the clamping mechanism of the present invention.
Figure 3B:
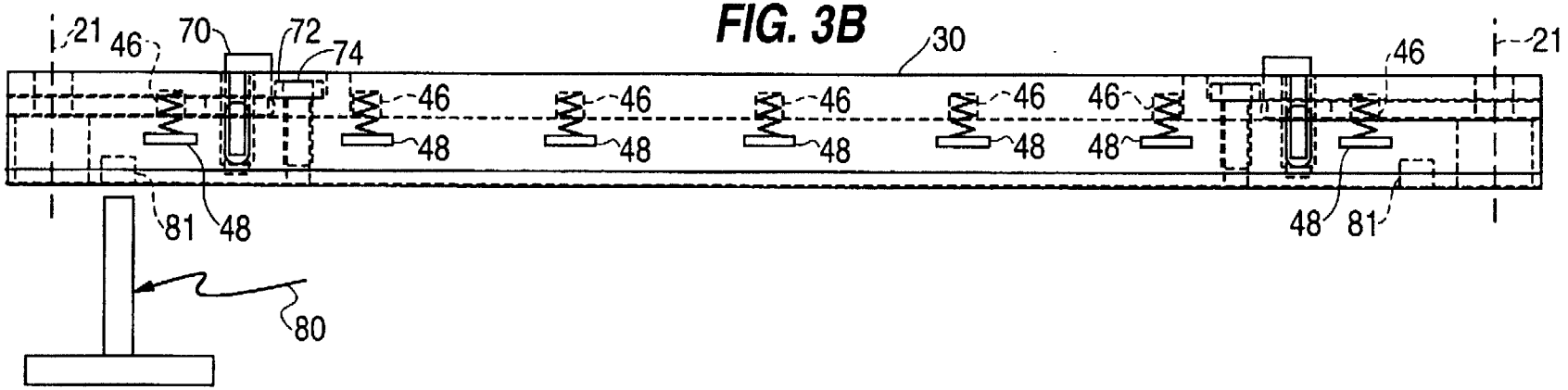
FIG. 3B is a side view of the clamping mechanism of the present invention.

In operation, the flexible printing plate 32 typically will have at least one edge, and in most cases both the leading and trailing edges bent at 90 degrees at a predetermined length from each end of the printing plate 32 and from each other. The leading edge of the printing plate 32 is inserted into the slot 20, and then into the clamping slot 42 of the clamping mechanism 40 until the leading edge is firmly seated against the outer diameter of the clamping shaft 44. After this operation, the edge 32A of the printing plate 32 is disposed between the clamping shaft 44 and the wall 41 of the clamping slot 42. The flexible printing plate 32 is then wrapped around the outer circumference of the printing cylinder 10 until the trailing edge 32A can be inserted into the slot 20, and then into the clamping slot 42. This trailing edge 32A of the printing plate 32 is likewise inserted between the clamping shaft 44 and the wall 41 of the clamping slot 42. Both ends of the printing plate 32 are pushed into the clamping slot 42 until they are firmly seated against the outer diameter of the clamping shaft 44. A dual purpose tool 80, shown in FIG. 3B, is used to tighten the threaded fasteners 52 and 54 by rotating them clockwise. This tool 80 may simply comprise a T-handled Allen wrench. The rotation of the threaded fasteners 52 and 54 clockwise acts to draw the clamping mechanism 30 toward the center of the printing cylinder 10, and away from the slot 20. This drawing or movement of the clamping mechanism 30 substantially away from the first slot 20 acts to draw the at least one edge 32A of the printing plate 22 towards the center of the printing cylinder 10, thereby tightening the flexible printing plate 32 around the printing cylinder 10. The threaded fasteners 52 and 54 can be tightened until all looseness is pulled out of the printing plate 32, even if the ends of the printing plate had been bent imperfectly.

In order to remove the printing plate 32 or adjust the printing plate 32, the tool 80 may be used to release the threaded fasteners 52 and 54 by rotating them in a counter-clockwise direction to move the clamping mechanism 30 toward the outer sleeve 11. The threaded fasteners 52 and 54 may be rotated until the clamping mechanism 30 touches the outer sleeve 11 of the printing cylinder 10. This action will tend to push the ends of the flexible printing plate 32 toward the first slot 20 so that the printing plate 32 is lifted from the outer diameter of the printing cylinder 10 slightly at the location of the slot 20.

Figure 4:
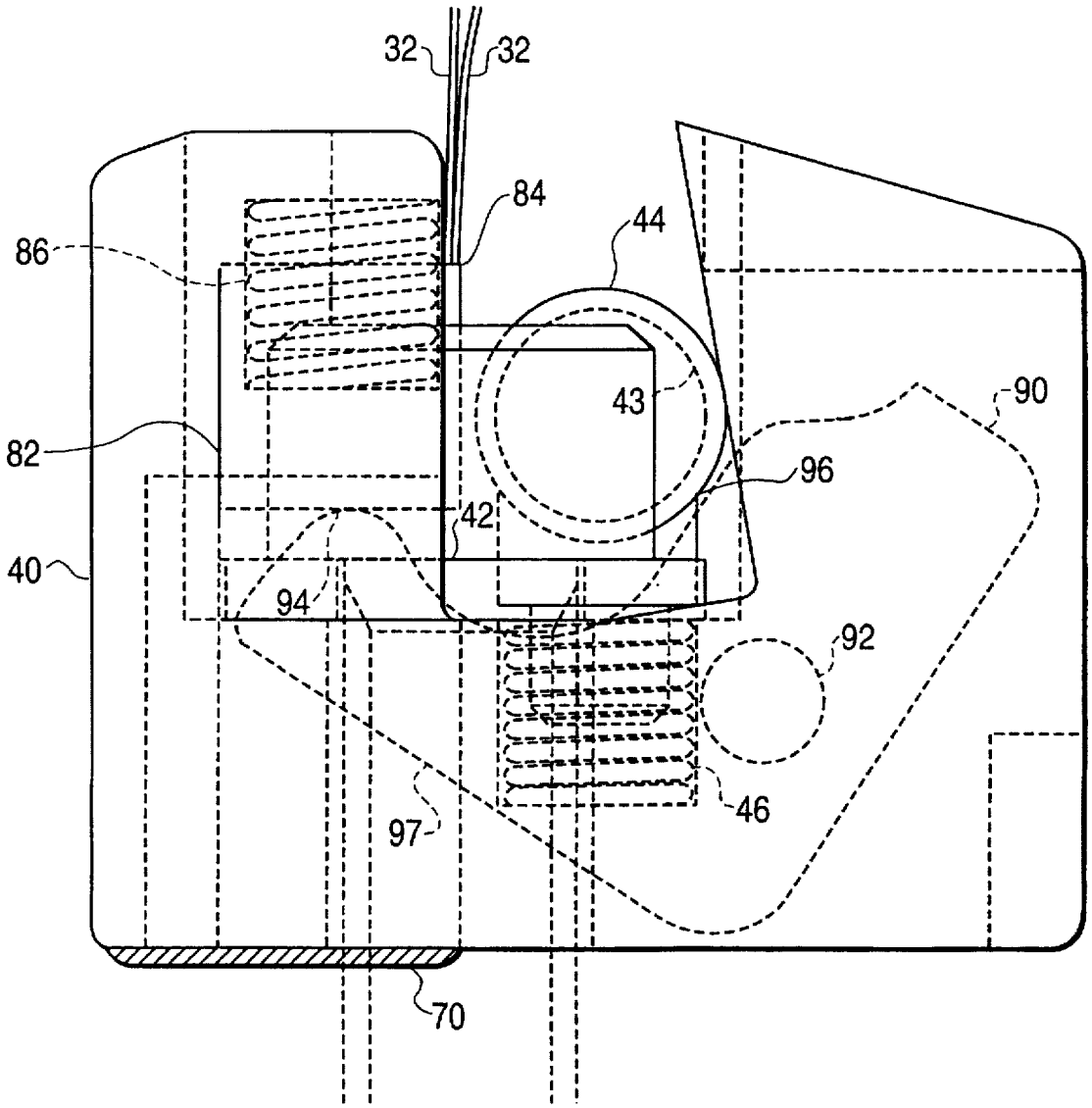
FIG. 4 is a side view of the clamping mechanism of the present invention.
Figure 6C:
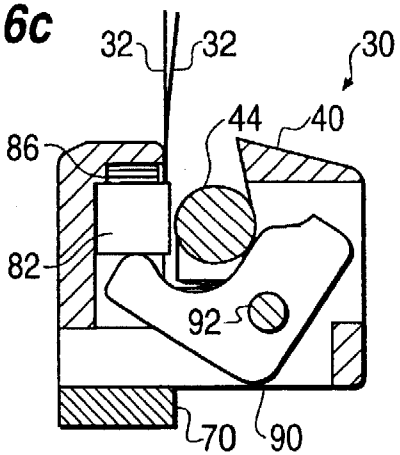
FIG. 6*c* is a side cross-section view of the clamping mechanism of the present invention in unload position.
Figure 6B:
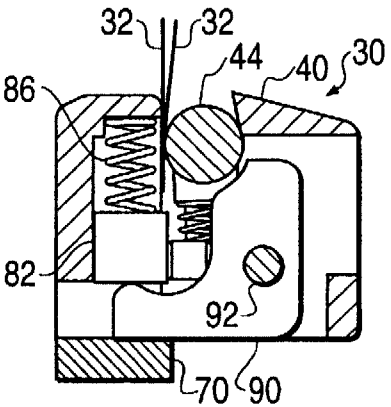
FIG. 6*b* is a side cross-section view of the clamping mechanism of the present invention in run position.
Figure 6A:
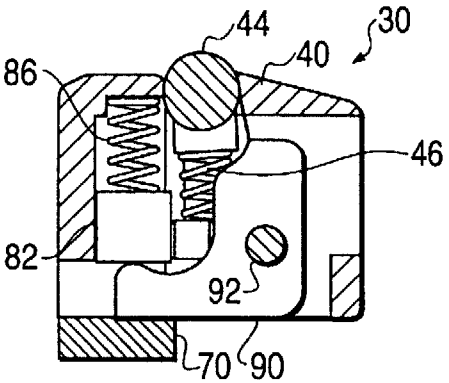
FIG. 6*a* is a side cross-section view of the clamping mechanism of the present invention in load position.

In a further aspect of the present invention, a mechanism is included in order to further release the flexible printing plate 32 from the printing cylinder 10. Referring now to FIGS. 2, 4, and **6*a*, 6*b*, and 6*c*, there is shown at least one piston 82 disposed within the plate clamp block 40 and aligned so that one end surface 84 is capable of pushing the at least one end of the flexible printing plate 32A in the clamping slot 42 outwardly toward the opening in the clamping slot 42 in the outer surface of the plate clamp block 40. A second bias device 86 is utilized for biasing the piston 82 to urge the one end 84 of the piston in a direction away from the at least one end of the flexible printing plate 32. In a preferred embodiment, the second bias device 86 comprises a spring. This mechanism further includes an actuating device 90 for causing the piston 82 to exert pressure to push the at least one end of the flexible printing plate 32 toward the opening in the clamping slot 42 of the outer surface of the plate clamp block 40, upon actuation. In a preferred embodiment, this actuating device 90 comprises a cam disposed in the clamping slot 42 to pivot about a pivot pin 92 so that a first surface 94 of the cam contacts the piston 82 and causes the piston 82 to push the at least one end of the flexible printing plate 32A toward the outer surface of the plate clamp block 40. This configuration further includes a pivot actuation device for causing the cam 90 to pivot upon actuation. In the embodiment shown in the figures, the pivot actuation device merely comprises the juxtaposition of the clamping shaft 44 in relation to a second surface 96 of the cam 90 so that when the clamping shaft 44 is pushed by an external force inward into the clamping slot 42, the clamping shaft 44 comes in contact with the second surface 96 of the cam and causes the cam to pivot about the pivot pin 92 so that the first cam surface 94 contacts the piston 82. The positions of the cam 90 in load position, in run position with the ends of the flexible plate 32 inserted into the clamping slot and secured by the clamping shaft 44, and in unload position with the ends of the flexible plate pushed up by the piston 82, are shown in FIG. 6***a*, FIG. 6*b*, and FIG. 6*c*, respectively. A slot 43 may be preferably machined into the surface of the clamping shaft 44 at the point where the clamping shaft is in adjacency with the piston 82 to prevent contact therebetween.

Figure 5:
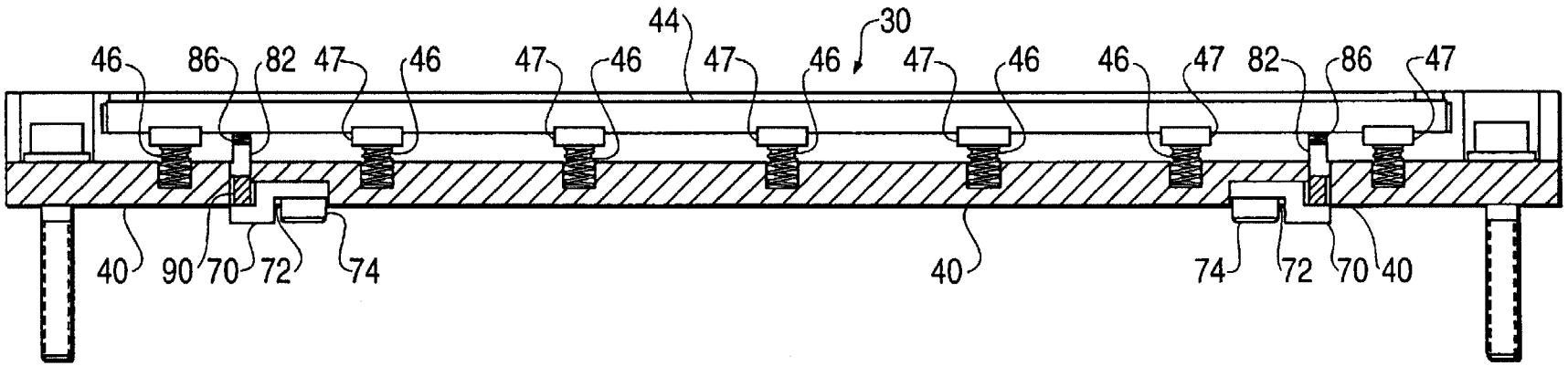
FIG. 5 is a longitudinal cross-section view of the clamping mechanism of the present invention.

In a preferred embodiment of the present invention, a stop pad 70 may be attached to the bottom surface of the plate clamp block 40. In FIG. 5, it can be seen that a portion of the plate clamp block 40 is milled away to receive a section 72 of the plate clamp block 70 so that the pad 70 may be attached to the plate clamp block via a screw 74. The pad 70 functions to prevent the cam 90 from rotating too far. The pad 70 functions to stop the movement of the cam when the cam surface 97 pivots down to touch the pad 70. The functioning of the pad 70 in this manner can be seen in FIG. 1.

In operation, the tool 80, or simply a rod, may be used to push down against the clamping shaft 44 to release it from the wedging action against the ends 32A of the printing plate 32. When the clamping shaft 44 is pushed toward the center of the printing cylinder 10, the clamping shaft 44 comes in contact with the surface 96 of the cam 90, causing the cam 90 to pivot about the pivot pin 92. This pivoting action of the cam 90 causes the surface 94 of the cam to push upward against the piston 82, which, in turn, pushes upward against the one or more ends of the printing plate 32A. The piston 82 causes the ends 32A of the printing plate 32 to move substantially toward the first slot 20, and preferably to lift out of the slot 20 enough to allow the operator to pull the printing plate 32 off without damaging the plate 32 or causing injury to fingers. This unload position is shown in FIG. 6*c*. Once the tool 80 has been removed so that there is no longer a downward pressure on the clamping shaft 44, the springs 46 and 86 return the moving parts back to their normal load positions. See FIG. 6*a*.

It should be noted that the spring 46 may further include a seat 47 with an arcuate surface to hold the clamping shaft 44. Likewise, it should be noted that the stop pad 70 may be on the order of ⅛ inch thick and typically will be made of a metal such as aluminum or steel.

It should be obvious to one skilled in the art that although the piston 82 is shown as being actuated mechanically by means of a cam 90 and the clamping shaft 44, it is well within the skill of the art to move the piston 82 up and down by means of electrical or electro-mechanical actuation.

Likewise, it should be noted that although the movement of the clamping mechanism 30 relative to the printing cylinder 10 is done by means of mechanical actuation, it is clear that this movement of the clamping mechanism 30 could be moved backward or forward substantially toward or away from the slot 20 by means of an electric motor or other form of electro-mechanical actuation.

In the preferred embodiment of the present invention, there may be multiple piston-cam assemblies for releasing the edges of the flexible printing plate 32. In the embodiment shown in FIG. 3A and 3B, two piston-cam assemblies are utilized. These assemblies are disposed at the position of the end caps for the printing cylinder 10.

It should be noted that it may be necessary to mill holes 81 in the printing cylinder 10 in order to allow the dual purpose tool 80 to be used to apply pressure on the clamping shaft 44 to push the clamping shaft downward toward the center of the printing cylinder 10. These holes 81 are shown in FIG. 3B.

The present invention addresses the problem of the narrow plate gap, and provides ease of operation and quick change of the printing plate, as well as allowing the re-use of printing plates, if desired. Utilizing the foregoing invention, the total cost of each printing cylinder would be within the limits necessary to allow it to be usable in the label marketplace, even if a clamping mechanism was installed in each printing cylinder. Utilizing the present invention, assembly is simple and easily accomplished. In some printing cylinder sizes, the clamping mechanism of the present invention can be removed and re-used in other printing cylinders, if desired.

Accordingly, the ease of clamping, the ease of applying tension to the printing plate and the ease of releasing tension on the printing plate and removing the plate from the printing cylinder that accrue from the use of the present invention significantly reduce printing plate change-over time and press down-time.

The present invention can be utilized in a variety of different printer markets including narrow web label printer markets, carton markets, ticket printers and tag printers. Additionally, the present invention can be utilized for soft rubber plates wherein the rubber plates have been formed with a metal plate backing. Additionally, it should be noted that the present invention is particularly useful in readjusting the alignment of the printing plate where skewing has occurred. If the ends of the printing plate have not been bent properly so that the ends are not perfectly aligned, then some adjustment may be necessary. The present invention can be utilized to tighten the printing plate around the printing cylinder and to loosen or release the printing plate around the printing cylinder with much greater ease than methods taught in the prior art.

It should be understood that the present invention may be utilized in any industry and equipment wherein cylindrical rolls are used.

Obviously, many modifications and variations of the present invention are possible in light of the above teachings. It is therefore to be understood that within the scope of the appended claims, the invention may be practiced otherwise than as specifically described.

What is claimed is:

1. A printing cylinder system for use in a printing press, comprising:

a printing cylinder having a narrow first slot extending lengthwise in an outer surface in said printing cylinder with first slot having a bissecting plane that includes an axis of said printing cylinder;

a clamping mechanism disposed movably within the volume of said printing cylinder for clamping a flexible printing plate securely around said printing cylinder;

a mounting mechanism for holding said clamping mechanism in a relative position within said printing cylinder and including control means for moving said clamping mechanism within said printing cylinder substantially toward or away from said first slot;

wherein said clamping mechanism comprises:

a plate clamp block with a longitudinal clamping slot disposed therein, with said clamping slot having an opening aligned to communicate with the outer surface of said plate clamp block, said clamping slot disposed to communicate with said first slot to receive and hold at least one edge of said flexible printing plate via said first slot;

wherein, once said at least one end of said flexible printing plate is received and held within said clamping slot said mounting mechanism is controlled to move said clamping mechanism relative to said first slot to tighten said flexible printing plate around said printing cylinder; and further comprising:

a first and a second shafts disposed one at either end of said printing cylinder and concentric therewith, and including at least one hole in each of said first and second shafts aligned approximately on the same centerplane as said first slot;

wherein said printing cylinder includes an end cap disposed on either end thereof, with each of said end caps including an opening therein;

wherein said clamping mechanism has a first and second ends thereof extending through said openings in the end caps so as to be positioned in parallel and spaced from said first and second shafts, said openings in said end caps being of a sufficient size to allow said clamping mechanism to be moveable within said openings so that said clamping mechanism can be moved toward or away from said first slot, and including at least one hole in each of said first and second ends of said clamping mechanism in registry with said at least one hole in said first and second shafts; and wherein said mounting mechanism comprises at least a first threaded fastener for securing said first end of said clamping mechanism to said first shaft, and a second threaded fastener for securing said second end of said clamping mechanism to said second shaft.

2. A printing cylinder system as defined in claim 1, wherein said first and second shafts comprise, respectively, a first and second journal bearings.

3. A printing cylinder system as defined in claim 2, wherein said clamping slot in said plate clamp block narrows as it reaches its opening at the outer surface of said plate clamp block; and wherein said clamping mechanism further comprises:

a clamping shaft disposed within said clamping slot and having a cross-sectional dimension larger than said opening in said clamping slot so that said clamping shaft is retained within said clamping slot;

first bias device for biasing said clamping shaft to urge it toward said opening of said clamping slot;

wherein when said at least one end of said flexible printing plate is inserted through said first slot and into said clamping slot, said first bias device pushes said clamping shaft against said edge of said flexible printing plate.

4. A printing cylinder system as defined in claim 3, wherein said clamping shaft is cylindrical in shape; and wherein said first bias device comprises a plurality of springs disposed periodically in said plate clamp block in operative compression between a surface of said plate clamp block and said cylindrical clamping shaft.

5. A printing cylinder system as defined in claim 3, further comprising:

at least one piston disposed within said plate clamp block and aligned so that one end surface thereof is capable of pushing said at least one end of said flexible printing plate in said clamping slot outwardly toward the outer surface of said plate clamp block;

a second bias device for biasing said piston to urge said one end thereof in a direction away from the at least one end of said flexible printing plate; and an actuating device for causing said piston to exert pressure to push said at least one end of said flexible printing plate toward the outer surface of said plate clamp block, upon activation.

6. A printing cylinder system as defined in claim 5, wherein said actuating device comprises:

a cam disposed in said clamping slot to pivot so that a first surface of said cam contacts said piston and causes said piston to push said at least one end of said flexible printing plate toward said clamping slot opening at the outer surface of said plate clamp block; and a pivot activating device for causing said cam to pivot upon actuation.

7. A printing cylinder system as defined in claim 6, wherein said pivot activating device comprises the juxtaposition of said clamping shaft in relation to a second surface of said cam so that when said clamping shaft is pushed by an external force inward into said clamping slot, said clamping shaft comes in contact with said second surface of said cam and causes said cam to pivot and contact said piston.

8. A printing cylinder system as defined in claim 5, wherein said clamping shaft is cylindrical and includes a slot in its circumference located where said clamping shaft is in adjacency with said at least one piston to prevent contact therebetween.

9. A printing cylinder system as defined in claim 1, wherein plate clamp block further comprises a respective stop pad disposed on the outer surface of said plate clamp block where said plate clamp block passes through said openings in each of said end caps, said stop pad disposed on the side of said plate clamp block to face the axis of said printing cylinder to prevent overtightening of said first and second threaded fasteners.

10. A printing cylinder system for use in a printing press, comprising:

a printing cylinder having a narrow first slot extending lengthwise in an outer surface in said printing cylinder, with the first slot having a bissecting centerplane that includes an axis of said printing cylinder;

a first shaft disposed at, and extending from, an end of said printing cylinder and in parallel with an axis of said printing cylinder;

a clamping mechanism disposed movably within the volume of said printing cylinder for clamping a flexible printing plate securely around said printing cylinder;

wherein said clamping mechanism has a first end thereof, extending beyond an end of said printing cylinder so as to be positioned in parallel and spaced from said first end of said clamping mechanism, with said clamping mechanism being movable toward or away from said first slot;

an adjustable fastener disposed approximately on said centerplane of said first slot for moving said first end of said clamping mechanism toward or away from said first shaft, to thereby move said clamping mechanism substantially toward or away from said first slot;

wherein said clamping mechanism comprises:

a plate clamp block with a longitudinal clamping slot disposed therein, with said clamping slot having an opening aligned to communicate with the outer surface of said plate clamp block, said clamping slot disposed to communicate with said first slot to receive and hold at least one edge of said flexible printing plate via said first slot.

11. A printing cylinder system as defined in claim 10, wherein said clamping slot in said plate clamp block narrows as it reaches its opening at the outer surface of said plate clamp block; and wherein said clamping mechanism further comprises:

a clamping shaft disposed within said clamping slot and having a cross-sectional dimension larger than said opening in said clamping slot so that said clamping shaft is retained within said clamping slot;

first bias device for biasing said clamping shaft to urge it toward said opening of said clamping slot;

wherein when said at least one end of said flexible printing plate is inserted through said first slot and into said clamping slot, said first bias device pushes said clamping shaft against said edge of said flexible printing plate.

12. A printing cylinder system as defined in claim 11, wherein said clamping shaft is cylindrical in shape and wherein said first bias device comprises a plurality of springs disposed periodically in said plate clamp block in operative compression between a surface of said plate clamp block and said cylindrical clamping shaft.

13. A printing cylinder system as defined in claim 10, further comprising:

at least one piston disposed within said plate clamp block and aligned so that one end surface thereof is capable of pushing said at least one end of said flexible printing plate in said clamping slot outwardly toward the outer surface of said plate clamp block;

a second bias device for biasing said piston to urge said one end thereof in a direction away from the at least one end of said flexible printing plate; and an actuating device for causing said piston to exert pressure to push said at least one end of said flexible printing plate toward the outer surface of said plate clamp block, upon activation.

14. A printing cylinder system as defined in claim 13, wherein said actuating device comprises:

a cam disposed in said clamping slot to pivot so that a first surface of said cam contacts said piston and causes said piston to push said at least one end of said flexible printing plate toward the outer surface of said plate clamp block; and a pivot activating device for causing said cam to pivot upon actuation.

15. A printing cylinder system as defined in claim 10, further comprising:

an assembly for pushing the at least one edge of said flexible printing plate outwardly toward the opening in said clamping slot upon actuation.

16. A printing cylinder as defined in claim 10, wherein said adjustable fastener comprises a threaded fastener which is threaded into aligned threaded holes in said first shaft and said first end of said clamping mechanism.

17. A printing cylinder system for use in a printing press, comprising:

a printing cylinder having a narrow longitudinal first slot extending the length of said printing cylinder, said printing cylinder including a first and second end caps disposed on respective ends of said printing cylinder, said first and second end caps each having an opening therein;

a first and second bearing journals at either end of said printing cylinder and concentric therewith;

a clamping mechanism including a plate clamp block disposed movably within the volume of said printing cylinder for clamping a flexible printing plate securely around said printing cylinder, said plate clamp block having a first and second ends thereof extending through said end caps in said printing cylinder and in parallel adjacency with said first and second bearing journals, wherein said opening in said end caps is of sufficient size to allow said plate clamp block to be movable within said opening so that said plate clamp block can be moved toward or away from said first slot, said plate clamp block including a longitudinal clamping slot therein, with said clamping slot narrowing as it reaches and opens to the outer surface of said plate clamp block, said clamping slot running the length of the plate clamp block and disposed to communicate with said first slot, said clamping mechanism further including a clamping shaft disposed longitudinally within said clamping slot and having a cross-sectional dimension larger than the opening of said clamping slot so that said clamping shaft is retained within said clamping slot;

said clamping mechanism further including at least two biasing devices to urge said clamping shaft toward said opening in said clamping slot, wherein when at least one end of said flexible printing plate is inserted through said first slot and into said clamping slot, said biasing devices push said clamping shaft against said end of said flexible printing plate;

a mounting mechanism for adjustably mounting the first and second ends of said plate clamp block to said first and second bearing journals so that said plate clamp block can be moved within said printing cylinder substantially toward or away from said first slot in order to either tighten or loosen said flexible printing plate around said printing cylinder; and a piston assembly for pushing the at least one edge of said flexible printing plate outwardly toward the outer surface of said plate clamp block upon actuation.

18. A printing cylinder system as defined in claim 17, wherein said mounting mechanism comprises a threaded fastener for adjustably attaching said first and second ends of said plate clamp block to said respective first and second bearing journals.

19. A printing cylinder as defined in claim 17, wherein said piston assembly comprises:

at least one piston disposed within said plate clamp block and aligned so that one end surface thereof is capable of pushing said at least one end of said flexible printing plate in said clamping slot outwardly toward the opening in said clamping slot;

a second bias device for biasing said piston to urge said one end thereof in a direction away from the at least one end of said flexible printing plate; and an actuating device for causing said piston to exert pressure to push said at least one end of said flexible printing plate toward the said clamping slot opening in the outer surface of said plate clamp block, upon activation.

20. A printing cylinder system as defined in claim 19, wherein said clamping shaft is cylindrical and includes a slot in its circumference located where said clamping shaft is in adjacency with said at least one piston to prevent contact therebetween.

21. A printing cylinder system for use in a printing press, comprising:

a printing cylinder having a narrow first slot extending lengthwise in an outer surface of said printing cylinder;

a clamping mechanism disposed within the volume of said printing cylinder, said clamping mechanism including a longitudinal clamping slot running in parallel with said printing cylinder and said first slot and opening toward and in communication with said first slot for receiving at least one edge of a flexible printing plate via said first slot for clamping said printing plate securely around said printing cylinder; and a device for pushing the at least one edge of said flexible printing plate outwardly toward said opening in said clamping slot at the outer surface of said clamping mechanism upon activation when said printing plate is to be adjusted or changed;

wherein said pushing device comprises:

at least one piston disposed within said clamping mechanism and aligned so that one end surface thereof is capable of pushing said at least one end of said flexible printing plate in said clamping slot outwardly toward said opening in said clamping slot at the outer surface of said opening mechanism;

a first bias device for biasing said piston to urge said one end thereof in a direction away from the at least one end of said flexible printing plate; and an actuating device for causing said piston to exert pressure to push said at least one said flexible printing plate toward said opening in said clamping slot at the outer surface of said clamping mechanism upon activation.

22. A printing cylinder system as defined in claim 21, further comprising a mounting mechanism for holding said clamping mechanism within said printing cylinder and means for moving said clamping mechanism within said printing cylinder either substantially toward or away from said first slot in order to either tighten or loosen said flexible printing plate around said printing cylinder.

23. A printing cylinder system as defined in claim 21, wherein said actuating device comprises:

a cam disposed in said clamping slot to pivot so that a first surface of said cam contacts said piston and causes said piston to push said at least one end of said flexible printing plate toward said opening in said clamping slot at the outer surface of said plate clamp block; and a pivot activating device for causing said cam to pivot upon actuation.

24. A printing cylinder system as defined in claim 23, wherein said clamping slot in said clamping mechanism narrows as it reaches the outer surface of said clamping mechanism; and wherein said clamping mechanism further comprises:

a clamping shaft disposed within said clamping slot and having a cross-sectional dimension larger than said opening in said clamping slot so that said clamping shaft is retained within said clamping slot; and second bias device for biasing said clamping shaft to urge it toward said opening in said clamping slot;

wherein when said at least one end of said flexible printing plate is inserted through said first slot and into said clamping slot, said second bias device pushes said clamping shaft against said edge of said flexible printing plate.

25. A printing cylinder system as defined in claim 24, wherein said pivot activating device comprises the juxtaposition of said clamping shaft in relation to a second surface of said cam so that when said clamping shaft is pushed by an external force inward into said clamping slot, said clamping shaft comes in contact with said second surface of said cam and causes said cam to pivot and contact said piston.

26. A method for securing and releasing a flexible plate that is wrapped around a cylinder, with at least one edge of the flexible plate being insertable into a narrow slot extending lengthwise in the outer surface of the cylinder, with said narrow slot having a bissecting centerplane that includes an axis of said cylinder, and wherein a clamping mechanism disposed movably within the cylinder clamps the edge of the flexible plate inserted through said narrow slot, said method comprising the steps of:

aligning a first shaft disposed at, and extending from, an end of said cylinder with a first end of said clamping mechanism that extends beyond an end of said cylinder so that said first shaft is positioned in parallel and spaced from said first end of said clamping mechanism;

inserting the edge of the flexible plate into the narrow slot in the cylinder;

clamping the edge of the flexible plate with the clamping mechanism disposed within the cylinder; and disposing an adjustable fastener approximately on said centerplane of said first slot and adjusting said adjustable fastener to move said first end of said clamping mechanism toward or away from said first shaft to thereby move the clamping mechanism relative to the narrow slot to change the tension on the flexible plate around the cylinder.

27. The method as defined in claim 26, wherein said clamping mechanism moving step comprises the step of moving said clamping mechanism directly toward or away from said narrow slot.

28. The method as defined in claim 26, wherein said method further includes the step of:

when it is time to adjust or change the flexible plate, moving the clamping mechanism substantially toward said narrow slot to reduce the tension on the flexible plate.

29. The method as defined in claim 26, wherein said method further comprises the steps of:

when it is time to adjust or change the flexible plate, releasing the edge of the flexible plate within the clamping mechanism; and then pushing the edge of the flexible plate outwardly from within the clamping mechanism toward the narrow slot.

30. The method as defined in claim 28, wherein said method step further comprises the step of:

after said moving toward the narrow slot step, releasing the edge of the flexible plate within the clamping mechanism; and then pushing the edge of the flexible plate outwardly from within the clamping mechanism toward the narrow slot.

31. A method for securing and releasing a flexible plate that is wrapped around a cylinder, with at least one edge of the flexible plate being insertable into a narrow slot extending lengthwise in the outer surface of the cylinder, and wherein a clamping mechanism disposed movably within the cylinder clamps to the edge of the flexible plate inserted through said narrow slot, said method comprising the steps of:

inserting the edge of the flexible plate into the narrow slot in the cylinder;

clamping the edge of the flexible plate with the clamping mechanism disposed within the cylinder;

when it is time to adjust or change the flexible plate, releasing the edge of the flexible plate within the clamping mechanism; and then pushing the edge of the flexible plate with a piston outwardly from within the clamping mechanism toward the narrow slot with a force parallel to a plane of the edge.

32. A clamping mechanism for disposal within a cylinder having a narrow first slot extending lengthwise in an outer surface of the cylinder, said clamping mechanism comprising:

a clamping block that extends for the length of said cylinder and is sized to fit within said cylinder, said clamping block including a longitudinal clamping slot running the length of said clamping block and positioned to open toward and run in parallel with said first slot when said clamping mechanism is inserted within said cylinder, said clamping slot for receiving at least one end of a flexible cover that is wrapped around said cylinder, with the at least one end inserted through said first slot and into said clamping slot when said clamping mechanism is positioned within said cylinder; and a pushing device including at least one piston disposed within said clamping slot and aligned so that one end surface thereof is positioned to push, with a force parallel to a plane of the end of the flexible cover, said at least one end of the flexible cover in said clamping slot outwardly toward the opening of the clamping slot upon activation;

wherein said pushing device further comprises:

a first bias device for biasing said piston to urge said one end thereof in a direction away from the at least one end of the flexible cover; and an actuating device for causing said piston to exert pressure to push said at least one end of said flexible cover toward the opening of said clamping slot upon activation.

33. A clamping mechanism as defined in claim 32, wherein said actuating device comprises:

a cam disposed in said clamping slot to pivot so that a first surface of said cam contacts said piston and causes said piston to push said at least one end of said flexible cover toward said opening in said clamping slot at the outer surface of said clamping block; and a pivot activating device for causing said cam to pivot upon actuation.

34. A clamping mechanism as defined in claim 33, wherein said clamping slot in said clamping block narrows as it reaches and opens to the outer surface of said clamping block; and wherein said clamping mechanism further comprises:

a clamping shaft disposed within said clamping slot and having a cross-sectional dimension larger than said opening of said clamping slot so that said clamping shaft is retained within said clamping slot; and second bias device for biasing said clamping shaft to urge it toward said opening of said clamping slot;

wherein when said at least one end of said flexible cover is inserted through said first slot and into said clamping slot, said second bias device pushes said clamping shaft against said edge of said flexible cover.

35. A clamping mechanism as defined in claim 34, wherein said pivot activating device comprises the juxtaposition of said clamping shaft in relation to a second surface of said cam so that when said clamping shaft is pushed by an external force inward into said clamping slot, said clamping shaft comes in contact with said second surface of said cam and causes said cam to pivot and contact said piston.

* * * * *